US006153130A

United States Patent [19]

Grady

[11] Patent Number: 6,153,130

[45] Date of Patent: Nov. 28, 2000

[54] METHOD OF INSTALLING A FORM IN A FOUNDRY FURNACE

[75] Inventor: Ayton Grady, Muskoka, Canada

[73] Assignee: Gradmatic Equipment Inc., Muskoka, Canada

[21] Appl. No.: 09/065,350

[22] Filed: Apr. 23, 1998

[51] Int. Cl.[7] ..... F27D 1/16

[52] U.S. Cl. ..... 264/30; 249/1; 249/15; 249/17; 249/83; 264/32; 264/35; 264/36.15; 264/36.18; 264/36.22; 266/281; 427/140

[58] Field of Search ..... 264/30, 32, 35, 264/36.15, 36.18, 36.2, 36.22; 266/281; 427/140; 249/1, 17, 15, 83

[56] References Cited

U.S. PATENT DOCUMENTS

| | | | |
|---|---|---|---|
| 1,599,161 | 9/1926 | Brayton, Jr. . | |
| 1,685,914 | 10/1928 | Foley . | |
| 2,774,123 | 12/1956 | Reighart . | |
| 3,148,272 | 9/1964 | Aitken et al. . | |
| 3,151,200 | 9/1964 | Spencer . | |
| 3,492,383 | 1/1970 | Heimgartner . | |
| 3,716,316 | 2/1973 | Dekker et al. | 425/13 |
| 3,836,612 | 9/1974 | Mann . | |
| 4,589,633 | 5/1986 | Gilson et al. | 266/44 |
| 4,726,570 | 2/1988 | Phillips et al. | 266/281 |

*Primary Examiner*—Karen Aftergut
*Attorney, Agent, or Firm*—Baker & Daniels

[57] ABSTRACT

A spacing tool to be inserted between a form and a foundry furnace during installation of the form in the foundry furnace comprises a first longitudinally extending member to contact the foundry furnace. A second longitudinally extending member is coupled to the first member. The first and second members define opposed surfaces to contact the form and foundry furnace respectively. The second member is moveable relative to the first member to alter the distance between the opposed surfaces and set the spacing between the form and the foundry furnace. During a foundry furnace relining process, a plurality of spacing tools are used at circumferentially spaced locations to center the form within the foundry furnace.

12 Claims, 5 Drawing Sheets

METHOD OF INSTALLING A FORM IN A FOUNDRY FURNACE

FIELD OF THE INVENTION

The present invention relates to foundry furnaces and in particular to a method of installing a form in a foundry furnace.

BACKGROUND OF THE INVENTION

Foundry induction furnaces are well known in the art. A typical foundry furnace includes a refractory base and a cylindrical outer wall extending vertically about the periphery of the base. An induction heating coil is accommodated by the outer wall. A continuous lining formed of sintered silica or other refractory material lines the cylindrical wall to define a chamber for molten metal such as iron melt.

From time to time, the lining of refractory material becomes eroded and requires replacement. When the foundry furnace is to be relined, an expendable steel form is concentrically disposed within the foundry furnace. Particulate refractory material is then poured into the annular space between the form and the cylindrical outer wall. The refractory material is sintered first by gas heaters fired into the foundry furnace and thereafter, by an initial charge of molten metal poured into the form. The molten metal melts the form to reveal the sintered lining.

During the relining process, it is important to ensure that the lining is uniform in thickness about the cylindrical outer wall since variations in lining thickness physically weaken the lining and create pockets where molten metal in the foundry furnace may be overheated. Therefore, when the form is being placed in the foundry furnace, it is important that the form be centrally positioned so that the annular space between the form and the outer cylindrical wall is uniform about its circumference.

Currently when a foundry furnace is to be relined, the form is suspended by a hoist and lowered into the foundry furnace. Workers positioned at circumferentially spaced locations about the foundry furnace hold onto the form as it is being lowered and guide the form in an attempt to place the form concentrically within the foundry furnace. Once the form has been lowered, the workers visually inspect the annular space between the form and the cylindrical outer wall to determine if the annular space is uniform. If the annular space does not appear to be uniform, the form is lifted and the process is repeated. In most instances, many attempts must be made before the form appears to be concentrically positioned within the foundry furnace. This of course lengthens the relining procedure and therefore, increases the downtime of the foundry furnace. Accordingly, improvements to foundry furnace relining procedures are desired.

It is therefore an object of the present invention to provide a novel method of installing a form in a foundry furnace.

SUMMARY OF THE INVENTION

According to one aspect of the present invention there is provided a method of installing a form in a foundry furnace comprising the steps of:

lowering said form into said foundry furnace; and placing spacing tools between said form and said foundry furnace at circumferentially spaced locations, said spacing tools acting between said form and said foundry furnace generally to center said form in said foundry furnace.

Preferably, during the form installation, the spacing tools are placed between the form and the foundry furnace as the form is being lowered into the foundry furnace. It is also preferred that the spacing tools are placed between the form and the foundry furnace at generally equal, circumferentially spaced locations.

Preferably, the spacing tools are suspended from the form as the form is being lowered into the foundry furnace. Each spacing tool is then individually adjusted to set the spacing between the form and the foundry furnace at the spaced locations to equal amounts thereby to center the form within the foundry furnace.

According to another aspect of the present invention there is provided a method of relining a foundry furnace comprising the steps of:

lowering a form into said foundry furnace;

placing spacing tools in the space between said form and said foundry furnace at circumferentially spaced locations and adjusting said spacing tools generally to center said form in said foundry furnace;

removing said spacing tools from said space once said form is generally centrally placed in said foundry furnace; and dispensing particulate refractory material into said space in preparation for sintering into a continuous lining.

According to still yet another aspect of the present invention there is provided a spacing tool to be inserted between a form and a foundry furnace during installation of said form in said foundry furnace, said spacing tool comprising:

a first longitudinally extending member; and a second longitudinally extending member coupled to said first member, said first and second members defining opposed surfaces to contact said foundry furnace and form respectively, said second member being moveable relative to said first member to alter the distance between said opposed surfaces and set the spacing between said form and said foundry furnace.

In a preferred embodiment, the second member is pivotally connected to the first member at longitudinally spaced locations. A lever is pivotally mounted on the first member and is coupled to the second member. Pivoting of the lever moves the second member relative to the first member. Preferably, the spacing tool further includes a releasable locking mechanism actuable to inhibit relative movement between the first and second members. It is preferred that the locking mechanism acts on the lever to inhibit the pivoting thereof. It is also preferred that the spacing tool further includes an indicator to provide a visual indication of the distance between the opposed surfaces.

In a preferred embodiment, the first member includes a hook-like extension to allow the spacing tool to be suspended from the form during lowering of the form into the foundry furnace.

The spacing tool in accordance with the present invention provides advantages in that it allows forms to be installed centrally within foundry furnaces accurately and quickly as compared to prior art methods. This of course allows foundry furnaces to be relined faster reducing foundry furnace downtimes.

BRIEF DESCRIPTION OF THE DRAWINGS

An embodiment of the present invention will now be described more fully with reference to the accompanying drawings in which.

DETAILED DESCRIPTION OF THE PREFERRED EMBODIMENTS

Figure 1:
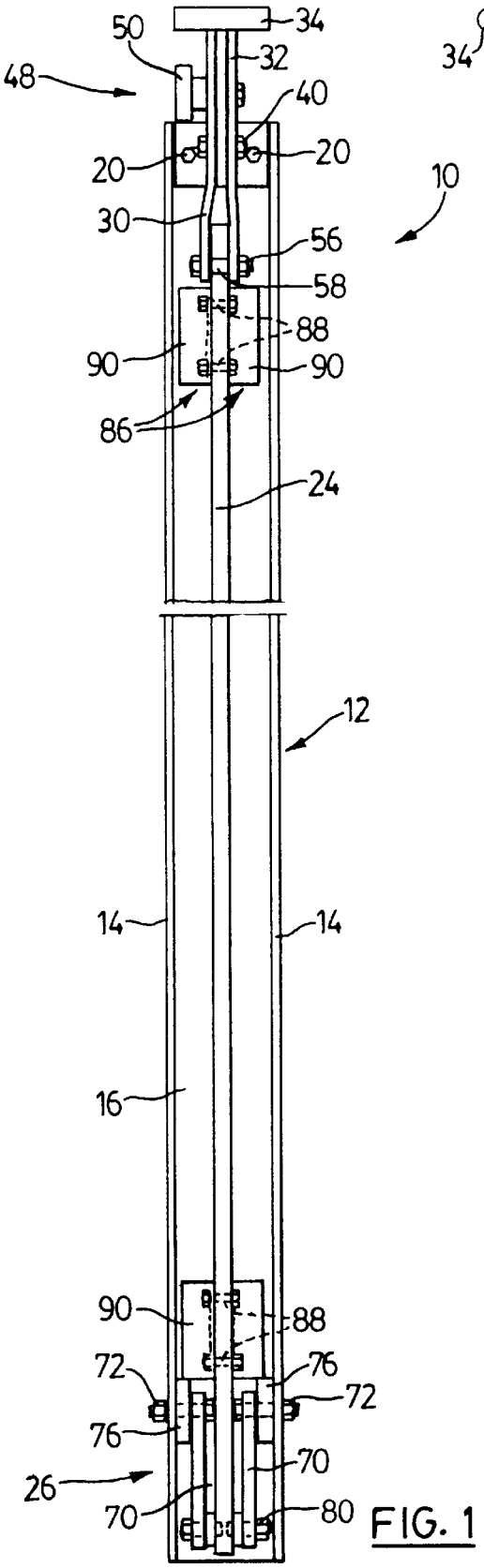
FIG. 1 is a front elevational view of a spacing tool in accordance with the present invention.
Figure 2:
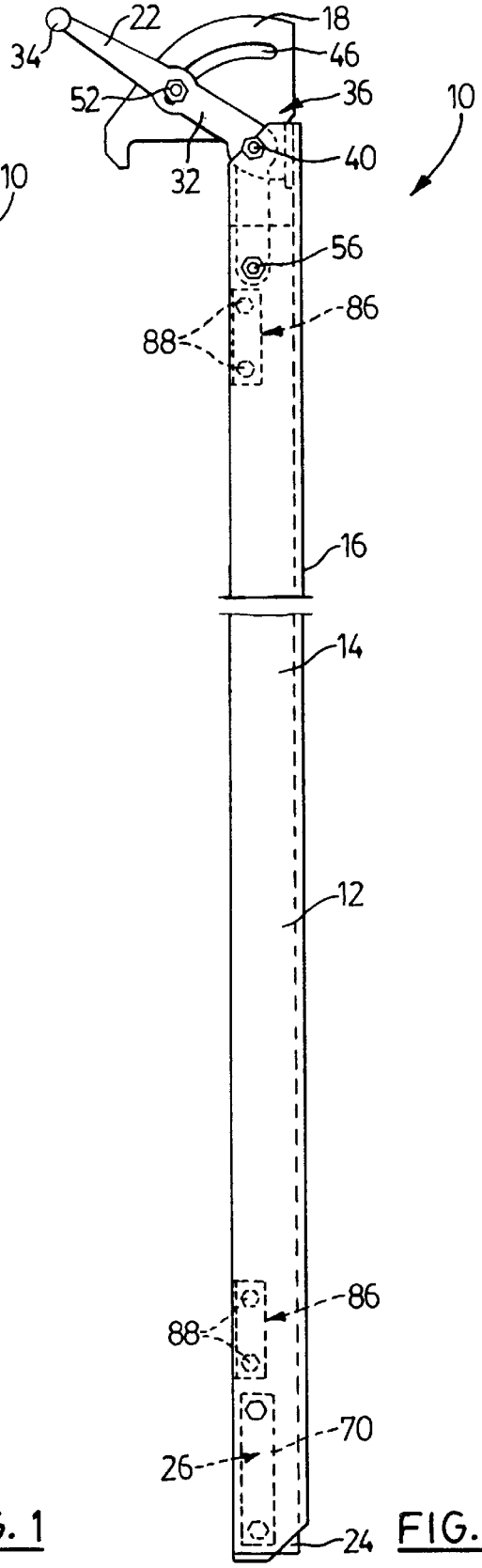
FIG. 2 is a side elevational view of the spacing tool of FIG. 1.

Referring now to FIGS. 1 and 2, a spacing tool to be inserted into the annular space between a form and the cylindrical wall of a foundry furnace during a foundry furnace relining process is shown and is generally indicated to by reference numeral 10. As can be seen, the spacing tool 10 includes a longitudinally extending channel member 12 having a pair of side walls 14 bridged by a rear wall 16. A hook-like extension 18 is secured to the rear wall 16 adjacent the top end of the channel member 12 by a pair of fasteners 20. A lever 22 is pivotally mounted on the extension 18 and is pivotally coupled to the upper end of a generally rectangular, longitudinally extending inner member 24. The inner member 24 is centrally positioned between the side walls 14 and is moveable laterally relative to the channel member 12 between a retracted position where the inner member is positioned within the channel member and an extended position where the inner member is forward of the side walls 14. A pivotal connection 26 near the bottom of the spacing tool 10 acts between the channel member 12 and the inner member 24.

Figure 3:
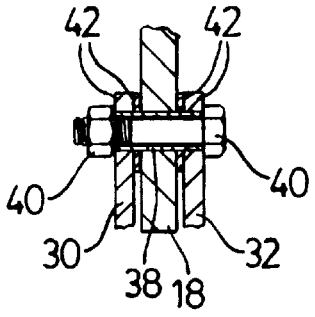
FIG. 3 is a front elevational view, partly in section, of a portion of the spacing tool of FIG. 1.
Figure 5:
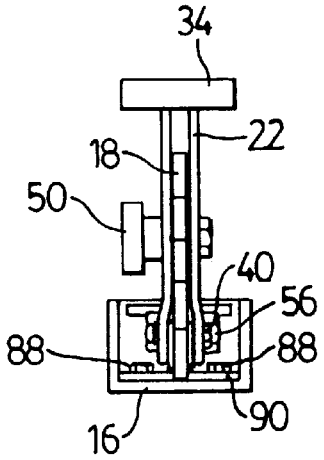
FIG. 5 is a top plan view of the spacing tool of FIG. 1.

The lever 22 includes a pair of laterally spaced 30 and 32 arms bridged at one end by a handle 34. The extension 18 extends through the space between the arms 30 and 32 beneath the handle 34. The arms 30 and 32 undergo a turn intermediate their lengths to define a pivot point 36. Aligned holes are provided through the arms 30 and 32 and extension 18 at the pivot point 36 and accommodate a bushing 38 (see FIG. 3). A fastener 40 in the form of a nut and bolt extends through the bushing 38 to secure the lever 22 to the extension 18 while permitting the lever 22 to pivot about the pivot point 36. Washers 42 act between the fastener 40 and the arms 30 and 32 as well as between the arms 30 and 32 and the extension 18. Aligned, internally threaded holes are also provided through the arms 30 and 32 intermediate the pivot point 36 and the handle 34. The holes are also aligned with an arcuate slot 46 in the extension 18. A manually operable, releasable locking mechanism 48 is mounted on the arm 30. The locking mechanism 48 includes a handle 50 and a threaded shaft 52 extending from the handle 50. The threaded shaft 52 engages the threaded holes in the arms 30 and 32 and passes through the slot 46. The upper surface of the extension 18 has gradations 54 thereon as shown in FIG. 5.

The distal ends of the arms 30 and 32 are coupled to the inner member 24 by way of a fastener 56 in the form of a nut and bolt passing through a bushing 58. The bushing 58 is accommodated by aligned holes in the arms 30 and 32 and inner member 24. Washers (not shown) act between the fastener 58 and the arms 30 and 32 as well as between the arms 30 and 32 and the inner member 24.

Figure 4:
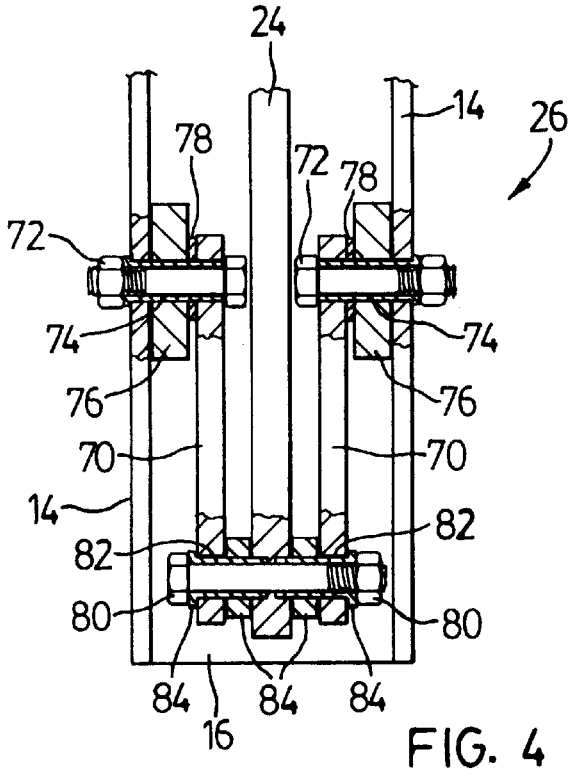
FIG. 4 is a front elevational view, partly in section, of another portion of the spacing tool of FIG. 1.

The pivotal connection 26 is best illustrated in FIG. 4 and is in the form of a parallelogram linkage including a pair of laterally spaced links 70 acting between the channel member 12 and the inner member 24. Each link 70 is pivotally connected to a respective side wall 14 of the channel member by way of a fastener 72 in the form of a nut and bolt passing through a bushing 74. The bushings 74 are accommodated by aligned holes in the links 70 and side walls 14 as well as in spacers 76 mounted on the interior of the side walls 14. Washers 78 act between the fasteners 72 and the links 70 as well as between the spacers 76 and links 70. The links 70 are also pivotally connected to the inner member 24 by way of a fastener 80 in the form of a nut and bolt passing through bushings 82. The bushings 82 are accommodated by aligned holes in the links 70 and inner member 24. Washers 84 act between the fastener 80 and the links 70 as well as between the links 70 and the inner member 24.

Pads 86 in the form of angles are secured to opposed sides of the inner member 24 at longitudinally spaced locations by way of fasteners 88 and define contact surfaces 90 in the same plane as the outer surface of the inner member. The pads 86 are however adjustable to position the contact surfaces 90 forward of the inner member 24 to accommodate tapered forms.

In the present embodiment, the channel member 12, extension 18 and the inner member 24 are formed of aluminum. The bushings and washers are formed of brass. The length of the spacing tool 10 is selected according to the depth of the foundry furnace and preferably is of a length less than the depth of the form. It is also preferred that the inner member 24 is moveable relative to the channel member 12 such that in the extended position, the distance between the outer surface of the inner member 24 and the outer surface of the rear wall 16 is equal to approximately 6 inches.

Figure 6:
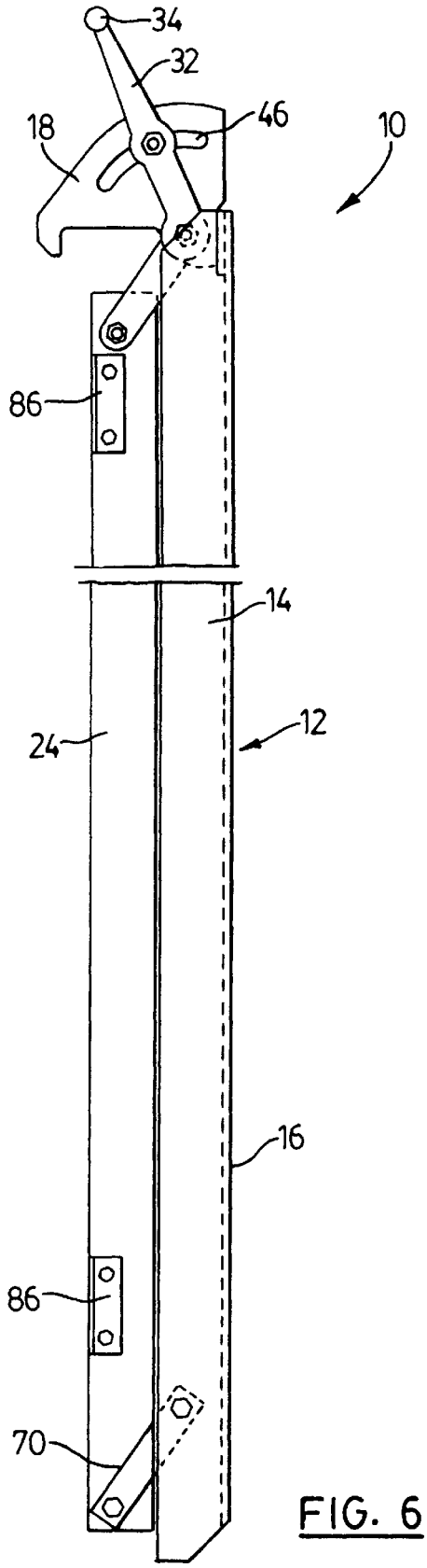
FIG. 6 is a side elevational view of the spacing tool of FIG. 1 in an extended position.

When the locking mechanism 48 is released, the lever 22 is free to pivot about pivot point 36. When the lever is in the fully forward position shown in FIG. 1, the inner member 24 assumes its fully retracted position and is positioned within the channel member 12 between the side walls 14. When the lever 22 is pivoted rearwardly about pivot point 36, the arms 30 and 32 swing the inner member 24 upwardly and away from the channel member 12 as shown in FIG. 6. The pivotal connections between the arms 30 and 32 and the inner member 24 and between the channel member 12 and the inner member 24 provide for this movement while maintaining the plane of the outer surface of the inner member 24 parallel with the plane of the rear wall 16.

During pivotal movement of the lever 22, the position of the lever with respect to the gradations 54 on the upper surface of the extension 18 provides a visual indication of the distance between the outer surface of the inner member 24 and the outer surface of the rear wall 16. When the distance between the outer surface of the inner member 24 and the outer surface of the rear wall 16 is equal to the desired distance, the lever 22 can be locked into position to inhibit any further relative movement between the inner member 24 and the channel member 12.

To lock the lever 22 in position, the handle 50 is rotated to advance the threaded shaft 52 through the holes in the arms 30 and 32. This causes the arms of the lever 22 to move together and contact the extension 18 so that frictional contact between the arms 30 and 32 and extension 18 inhibits pivoting of the lever. To unlock the lever 22, the handle 50 simply needs to be rotated in the opposite direction.

Figure 7:
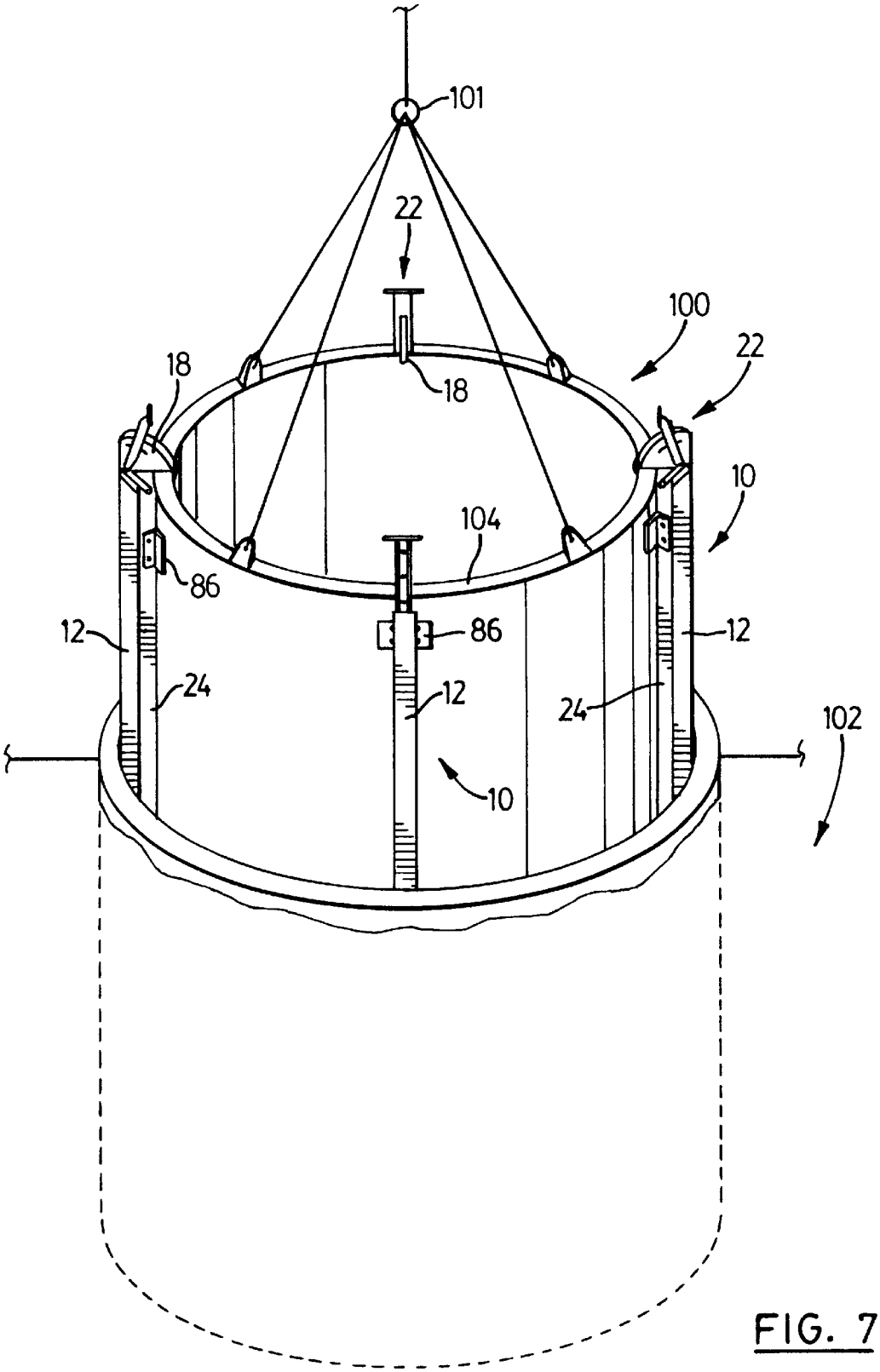
FIG. 7 is a perspective view of a form being installed in a foundry furnace using a plurality of spacing tools in accordance with the present invention.
Figure 8:
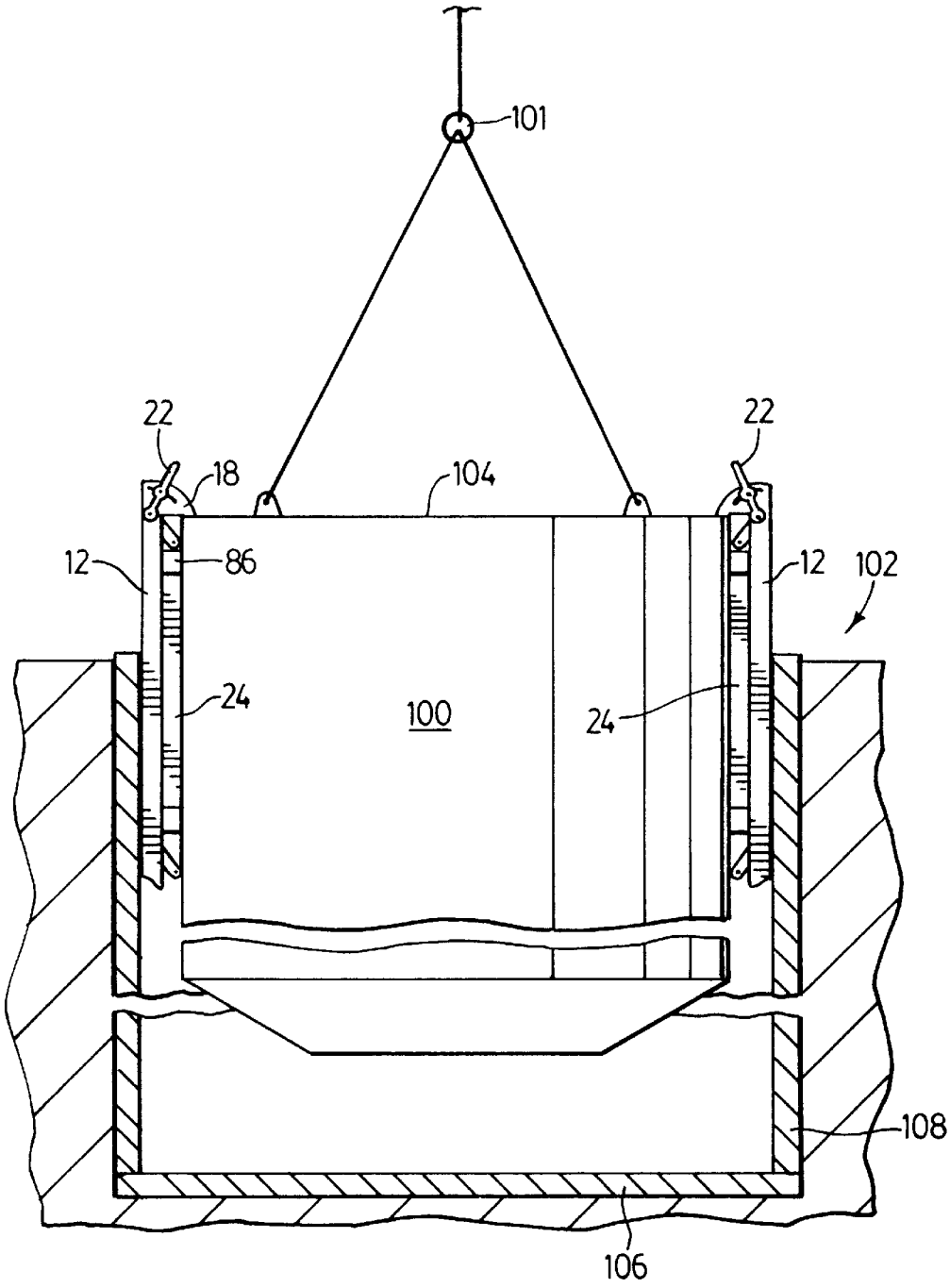
FIG. 8 is a cross-sectional view of FIG. 7 taken along line 8—8.

During a foundry furnace relining process, a plurality of spacing tools 10 in accordance with the present invention are used. A foundry furnace relining process implementing the spacing tools of the present invention will now be described with particular reference to FIGS. 7 and 8. During the foundry furnace relining process, a cylindrical form 100 is suspended from a hoist 101 and is lowered into the foundry furnace 102. As the form is being lowered into the foundry furnace, a plurality of spacing tools 10, in this example four, are suspended from the form 100 at generally equal circumferentially spaced locations by engaging the hook-like extensions 18 on the upper rim 104 of the form. The inner members 24 of the spacing tools are in the fully retracted positions.

The form 100 is lowered until it is suspended slightly above the base 106 of the foundry furnace. At this time, the levers 22 of the spacing tools 10 are pivoted rearwardly to move the inner members 24 upwardly and out of the channel members 12. As this is done, the rear walls 16 of the channel members 12 bear against the cylindrical wall 108 of the foundry furnace while the pads 86 and the outer surfaces of the inner members 24 bear against the form 100. The levers 22 are pivoted by the same amount and a sufficient distance so that each spacing tool 10 bears firmly against the cylindrical wall 108 and the form 100 signifying that the form is centered in the foundry furnace 102. At this point, the form is lowered to the base 106 of the foundry furnace. With the form centered and resting on the base 106 of the foundry furnace 102, the levers 22 are pivoted to their fully forward positions to retract the inner members 24 allowing the spacing tools to be removed from the annular space between the form and foundry furnace. Particulate refractory material can then be poured between the form and the foundry furnace either manually or using an apparatus such as that shown in U.S. Pat. No. 5,058,776 to Courtney et al. Once the refractory material has been poured between the form and foundry furnace, the refractory material is sintered thereby completing the foundry furnace relining process.

The present invention provides advantages in that forms can be placed within the foundry furnace and centered quickly and accurately as compared to conventional methods. This helps to expedite the foundry furnace relining procedure reducing foundry furnace downtime.

Although a particular embodiment of the present invention has been described, those of skill in the art will appreciate that variations and modifications may be made without departing from the spirit and scope thereof as defined by the appended claims.

I claim:

1. A method of installing a form in a foundry furnace comprising the steps of:

lowering said form into said foundry furnace;

placing elongate, downwardly extending spacing tools between said form and said foundry furnace at circumferentially spaced locations, said spacing tools acting between said form and said foundry furnace;

adjusting the spacing tools from above the form so that the spacing tools bear against the form and the foundry furnace thereby to center the form in said foundry furnace; and removing the spacing tools from between said form and said foundry furnace after said form has been centered.

2. The method of claim 1 wherein said spacing tools are placed between said form and said foundry furnace as said form is being lowered into said foundry furnace.

3. The method of claim 2 wherein said spacing tools are placed between said form and said foundry furnace at generally equal circumferentially spaced locations.

4. The method of claim 3 further comprising the step of suspending said spacing tools from said form as said form is being lowered into said foundry furnace.

5. The method of claim 1 wherein said spacing tools are adjusted with said form being suspended above a base of said foundry furnace and wherein said form is lowered onto said base once said form is centered within said foundry furnace.

6. The method of claim 5 further comprising the step of suspending said spacing tools from said form as said form is being lowered into said foundry furnace.

7. The method of claim 1 further comprising the step of suspending said spacing tools from said form as said form is being lowered into said foundry furnace.

8. A method of relining a foundry furnace having a base and an inner wall extending upwardly about a periphery of said base, said method comprising the steps of:

lowering a form into said foundry furnace and suspending the form above the base of said foundry furnace;

inserting elongate spacing tools in a space between said form and said foundry furnace at circumferentially spaced locations;

adjusting the spacing tools from above the form so that the spacing tools bear against the inner wall of said foundry furnace and an outer wall of said form thereby to center the form within said foundry furnace;

lowering said form onto the base of said foundry furnace once centered and removing said spacing tools from said space;

dispensing particulate refractory material into said space in preparation for sintering into a continuous lining; and sintering the particle refractory material to form said continuous lining.

9. The method of claim 8 wherein said spacing tools are placed in said space at generally equal, circumferentially spaced locations.

10. The method of claim 9 further comprising the step of suspending said spacing tools from said form as said form is being lowered into said foundry furnace.

11. The method of claim 8 wherein said spacing tools are inserted in the space between said form and said foundry furnace as said form is being lowered into said foundry furnace.

12. The method of claim 11 wherein said spacing tools are inserted in said space at generally equal, circumferentially spaced locations.

* * * * *